US012036601B2

(12) United States Patent
Dobashi

(10) Patent No.: US 12,036,601 B2
(45) Date of Patent: Jul. 16, 2024

(54) MANUFACTURING APPARATUS FOR ACCESSORY

(71) Applicant: Crossfor Co., Ltd., Kofu (JP)

(72) Inventor: Hidetaka Dobashi, Kofu (JP)

(73) Assignee: CROSSFOR CO., LTD., Kofu (JP)

( * ) Notice: Subject to any disclaimer, the term of this patent is extended or adjusted under 35 U.S.C. 154(b) by 0 days.

(21) Appl. No.: 18/552,495

(22) PCT Filed: Aug. 9, 2022

(86) PCT No.: PCT/JP2022/030430
§ 371 (c)(1),
(2) Date: Sep. 26, 2023

(87) PCT Pub. No.: WO2023/032616
PCT Pub. Date: Mar. 9, 2023

(65) Prior Publication Data

US 2024/0082905 A1 Mar. 14, 2024

(30) Foreign Application Priority Data

Sep. 1, 2021 (JP) ..... 2021-142694

(51) Int. Cl.
*B21D 53/44* (2006.01)
*A44C 27/00* (2006.01)

(52) U.S. Cl.
CPC ..... *B21D 53/44* (2013.01); *A44C 27/00* (2013.01)

(58) Field of Classification Search
CPC ..... B21D 53/44; B21D 43/05; B21D 43/003; B21D 24/005; B21D 24/16; B21D 11/20;
(Continued)

(56) References Cited

U.S. PATENT DOCUMENTS 4,570,474 A * 2/1986 Tanaka ..... B21D 11/18 72/383
2018/0361455 A1* 12/2018 Sohmshetty ..... B21D 24/16
(Continued)

FOREIGN PATENT DOCUMENTS

JP 46-017061 B1 5/1971
JP 53-019962 A 2/1978
(Continued)

OTHER PUBLICATIONS

International Search Report issued on Oct. 11, 2022, in corresponding International application No. PCT/JP2022/030430; 5 pages.
(Continued)

*Primary Examiner* — Teresa M Ekiert
(74) *Attorney, Agent, or Firm* — Maier & Maier, PLLC

(57) ABSTRACT

A manufacturing apparatus for an accessory, including: a magazine holding unit in which a material magazine that holds a metal sheet material in a roll shape is arranged; a material feeding unit that repeats conveyance in which the metal sheet material is fed forward from the material magazine, and stop of the conveyance; a die-set unit that includes a die set which blanks the metal sheet material conveyed from the material feeding unit into a predetermined shape; a machining unit that bends a metal component formed by the blanking in the die-set unit; and a guide unit that is provided between the material feeding unit and the die-set unit, and that flattens and feeds the metal sheet material conveyed from the material feeding unit to the die-set unit, the guide unit including restricting the metal sheet material in a width direction of the metal sheet material.

6 Claims, 8 Drawing Sheets

(58) Field of Classification Search
CPC ..... B21D 11/22; B21D 28/14; B21D 28/32; B21D 28/04; B21D 5/002
See application file for complete search history.

(56) References Cited

U.S. PATENT DOCUMENTS

| | | | | |
|---|---|---|---|---|
| 2019/0388948 | A1* | 12/2019 | Sohmshetty | B21D 28/14 |
| 2020/0406331 | A1* | 12/2020 | Charles | B21D 28/14 |

FOREIGN PATENT DOCUMENTS

| | | | |
|---|---|---|---|
| JP | 07-067710 | A | 3/1995 |
| JP | 10-137012 | A | 5/1998 |

OTHER PUBLICATIONS

Written Opinion issued on Oct. 11, 2022 in corresponding International application No. PCT/JP2022/030430; 5 pages.

* cited by examiner

MANUFACTURING APPARATUS FOR ACCESSORY

TECHNICAL FIELD

The present invention relates to a manufacturing apparatus for an accessory, and more particularly, to a manufacturing apparatus for an accessory using a cup chain.

BACKGROUND ART

As an example of jewelry goods, there is an accessory such as a necklace or a bracelet of a cup-chain type (what is called a tennis-chain type). The cup chain is formed by coupling metal cups to each other into a chain shape, and by incorporating jewelry into these cups.

Patent Literature 1 discloses a tennis-type chain for jewelry goods and a manufacturing method for the same. This manufacturing method enables links to be easily manufactured with use of automatic machinery. In addition, Patent Literature 2 discloses an accessory that allows a decorative member such as jewelry to be mounted without impairing its intrinsic beauty, and that prevents this mounted accessory from dropping.

SUMMARY

The cup chain is manufactured by feeding a metal sheet material in a roll shape to a die set, blanking metal components to be cups out of the metal sheet material with use of the die set, bending the metal components into a three-dimensional cup shape, and coupling the metal components to each other into a chain shape. A manufacturing apparatus for the cup chain is capable of automatically feeding forward the metal sheet material from a material magazine to the die set, blanking the metal sheet material at predetermined timings, bending the metal components into the cup shape, and coupling the metal components to each other into the chain shape. In such a manufacturing apparatus for the cup chain, if the metal sheet material has been curved or warped at a time of feeding forward the metal sheet material in the roll shape from the material magazine to the die set at the predetermined timings, the metal sheet material cannot be stably fed. As a result, continuous operation is hindered, and accuracy of the blanking is deteriorated.

The present invention has been made to achieve an object of providing a manufacturing apparatus for an accessory, the manufacturing apparatus being capable of stably feeding a metal sheet material in a roll shape into a die set.

According to an aspect of the present invention, there is provided a manufacturing apparatus for an accessory, the manufacturing apparatus machining a metal sheet material in a roll shape into a cup chain, and including:

- a magazine holding unit in which a material magazine that holds the metal sheet material in the roll shape is arranged;
- a material feeding unit
  - that is arranged in a stage subsequent to the magazine holding unit, and
  - that repeats
    - conveyance in which the metal sheet material is fed forward from the material magazine, and
    - stop of the conveyance;
- a die-set unit
  - that is arranged in a stage subsequent to the material feeding unit, and
  - that includes a die set which blanks the metal sheet material conveyed from the material feeding unit into a predetermined shape;
- a machining unit
  - that is arranged in a stage subsequent to the die-set unit, and
  - that bends a metal component formed by the blanking in the die-set unit; and
- a guide unit
  - that is provided between the material feeding unit and the die-set unit, and
  - that flattens and feeds the metal sheet material conveyed from the material feeding unit to the die-set unit,
- the guide unit including a thickness restricting portion that restricts the metal sheet material in a thickness direction of the metal sheet material,
- the thickness restricting portion including a slope portion for reducing a clearance in the thickness direction from an upstream side to a downstream side in a conveying direction of the metal sheet material, the clearance being formed by the thickness restricting portion.

With such a configuration, at a time of feeding forward the metal sheet material from the magazine holding unit to the die-set unit, the metal sheet material in the roll shape is flattened by the guide unit. In addition, the metal sheet material is gradually restricted in its thickness direction by passing the slope portion of the guide unit. With this, the metal sheet material is fed to the die-set unit with its curve or warp having been corrected.

In the manufacturing apparatus for the accessory, the slope portion is preferred to be provided on a side where an inlet for the metal sheet material is present among sides of the guide unit. With this, the clearance is enlarged on the side where the inlet for the metal sheet material is present. Thus, the metal sheet material is easily fed into the guide unit.

In the manufacturing apparatus for the accessory,

- the clearance in the thickness direction is preferred to include a clearance in the thickness direction on the downstream side in the conveying direction in the slope portion, and
- the thickness restricting portion is preferred to further include a flat portion for maintaining the clearance in the thickness direction on the downstream side in the conveying direction in the slope portion, the flat portion being provided on a side where an outlet for the metal sheet material is present among the sides of the guide unit. With this, the metal sheet material that has been restricted in its thickness direction by the slope portion is straightened by the flat portion. Thus, the metal sheet material is stably supplied to the die-set unit.

In the manufacturing apparatus for the accessory,

- the clearance in the thickness direction is preferred to include a clearance in the thickness direction on the upstream side in the conveying direction in the slope portion, and
- the clearance in the thickness direction on the downstream side in the conveying direction in the slope portion is preferred to be ⅓ or more and ½ or less of the clearance in the thickness direction on the upstream side in the conveying direction in the slope portion. With this, a somewhat large clearance is provided on the upstream side in the conveying direction in the slope portion, which enables the metal sheet material to be easily fed into the guide unit. Thus, the clearance is gradually restricted to ⅓ or more and ½ or less toward the downstream side in the conveying direction in the slope portion. In this way, the metal sheet material can be gradually restricted in its thickness direction while increase in conveying resistance of the metal sheet material is suppressed.

In the manufacturing apparatus for the accessory, the guide unit is preferred to further include a width restricting portion that restricts the metal sheet material in a width direction of the metal sheet material. With this, the metal sheet material can be restricted not only in its height direction but also in its width direction. Thus, the metal sheet material can be stably supplied to the die-set unit.

In the manufacturing apparatus for the accessory, the material feeding unit may include pads that sandwich a front and a rear of the metal sheet material, and may repeat, in synchronization with timings of the blanking of the metal sheet material in the die-set unit, sandwiching the metal sheet material with use of the pads, feeding forward the metal sheet material that has been sandwiched between the pads, and releasing the metal sheet material from the pads.

When the metal sheet material is fed by repeating the sandwiching with use of the pads and the releasing from the pads, the metal sheet material is liable to be curved or warped while fed. Even in a case where the material feeding unit has such a configuration, when the guide unit provided in a stage subsequent thereto restricts the metal material in its thickness direction, the metal sheet material can be fed to the die-set unit with its curve or warp having been eliminated.

According to the present invention, it is possible to provide the manufacturing apparatus for an accessory, the manufacturing apparatus being capable of stably feeding a metal sheet material in a roll shape into a die set.

DETAILED DESCRIPTION OF EMBODIMENTS

Below, an embodiment of the present invention is described with reference to the drawings. Note that, in the following description, like components are denoted by like reference symbols, and redundant description of these components is omitted as appropriate.

(Configuration of Manufacturing Apparatus for Accessory)

Figure 1:
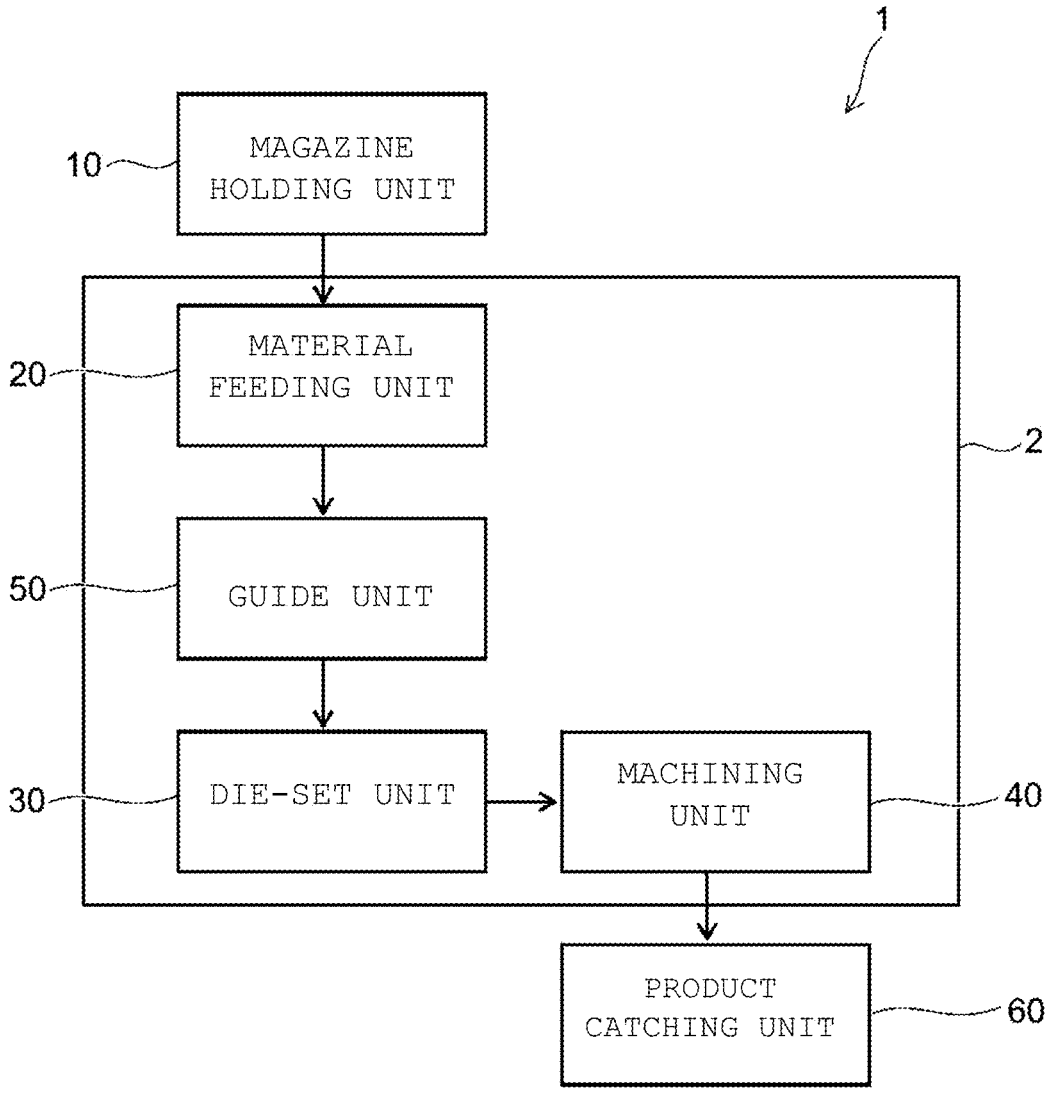
FIG. 1 is an exemplary block diagram of a configuration of a manufacturing apparatus for an accessory according to an embodiment of the present invention.

FIG. 1 is an exemplary block diagram of a configuration of a manufacturing apparatus for an accessory according to the embodiment.

Figure 2:
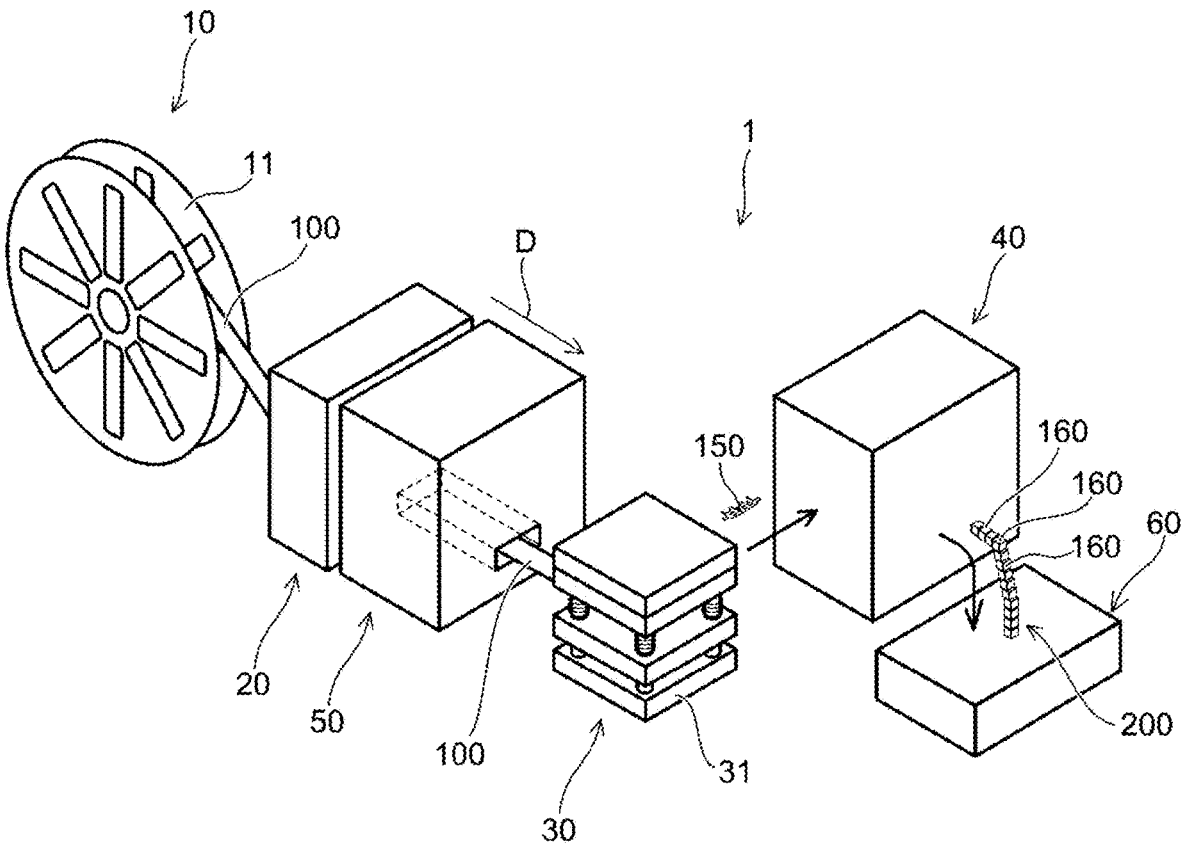
FIG. 2 is an exemplary schematic view of the configuration of the manufacturing apparatus for the accessory according to the embodiment.

FIG. 2 is an exemplary schematic view of the configuration of the manufacturing apparatus for the accessory according to the embodiment.

A manufacturing apparatus 1 for the accessory according to this embodiment is an apparatus for automatically manufacturing a cup chain 200 by machining a metal sheet material 100 in a roll shape. The manufacturing apparatus 1 includes a magazine holding unit 10, a material feeding unit 20, a die-set unit 30, a machining unit 40, a guide unit 50, and a product catching unit 60.

The magazine holding unit 10 is a part that holds a material magazine 11 in which the metal sheet material 100 with a predetermined width is held in a roll shape. Gold (such as 18-karat gold), silver, platinum, or the like is used as the metal sheet material 100 to be a material of the cup chain 200. A width of the metal sheet material 100 is, for example, 10 mm or 11.5 mm, and a thickness of the same is, for example, 0.2 mm. The material magazine 11 is provided with the long metal-sheet material 100 rolled around a reel. The magazine holding unit 10 is provided on an outside of a body 2 of the manufacturing apparatus 1 so that the material magazine 11 is easily replaced.

The material feeding unit 20 is arranged in a stage subsequent to the magazine holding unit 10, and includes a drive mechanism that feeds the metal sheet material 100 to the die-set unit 30 by repeating conveyance in which the metal sheet material 100 is fed forward from the material magazine 11, and stop of the conveyance. The die-set unit 30 is arranged in a stage subsequent to the material feeding unit 20, and includes a die set 31 for blanking the metal sheet material 100 into a predetermined shape. By blanking the metal sheet material 100 with use of the die set 31, a metal component 150 for constituting one of the cups 160 of the cup chain 200 is formed.

The machining unit 40 is a section that is arranged in a stage subsequent to the die-set unit 30, and that bends the metal component 150 formed by blanking in the die-set unit 30. The metal component 150 formed by blanking the metal sheet material 100 with use of the die set 31 has a flat sheet shape. The machining unit 40 forms the cup 160 into a three-dimensional shape, for example, by bending and welding the flat-sheet-shaped metal component 150. In addition, the machining unit 40 not only forms the cup 160, but also automatically couples the plurality of cups 160 to each other into a chain shape. The finished cup chain 200 is delivered to the product catching unit 60 arranged on the outside of the body 2.

In such a manufacturing apparatus 1, the guide unit 50 is provided between the material feeding unit 20 and the die-set unit 30. The guide unit 50 is a section that guides the forward feeding of the metal sheet material 100 in a manner that the metal sheet material 100 conveyed from the material feeding unit 20 is flattened and fed to the die-set unit 30. Details of the guide unit 50 are described below.

(Material Magazine and Material Feeding Unit)

Figure 3A:
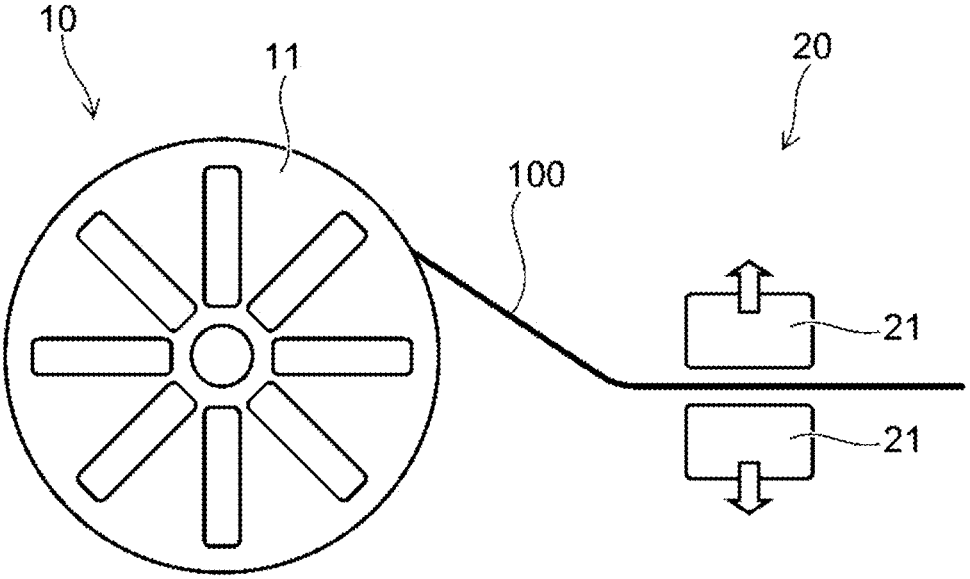
FIG. 3A and FIG. 3B are exemplary schematic views of a section from a material magazine to a material feeding unit.
Figure 3B:
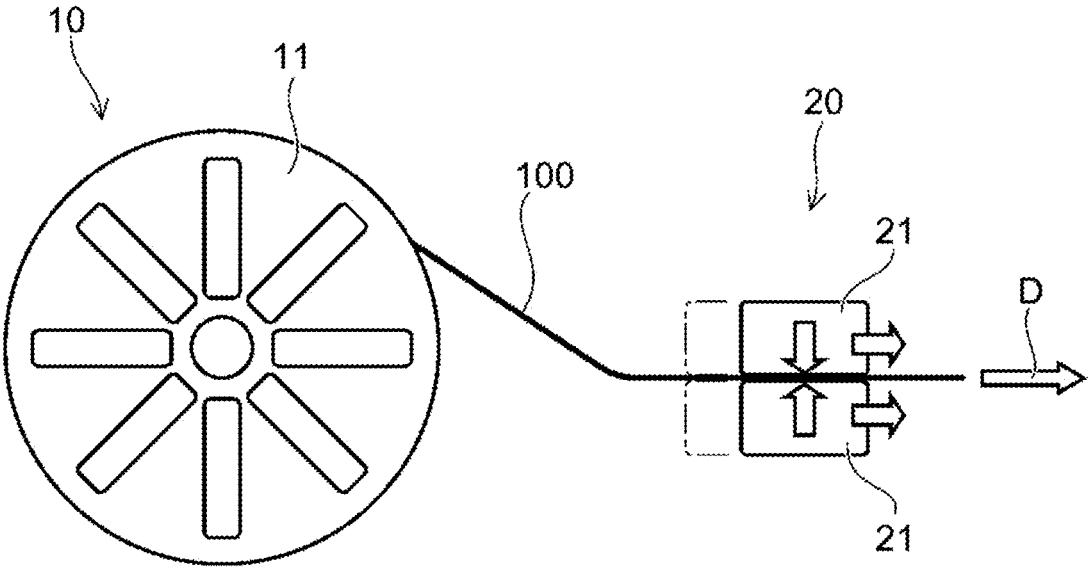

FIG. 3A and FIG. 3B are exemplary schematic views of a section from the material magazine to the material feeding unit. FIG. 3A illustrates a state in which a pair of pads 21 are separated from the metal sheet material 100, and FIG. 3B illustrates a state in which the pair of pads 21 have sandwiched the metal sheet material 100.

The metal sheet material 100 that has been drawn out of the material magazine 11 of the magazine holding unit 10 has been led in the material feeding unit 20 in advance. The material feeding unit 20 includes the pair of pads 21. The pair of pads 21 are configured to be capable of sandwiching the metal sheet material 100 from above and below. The pair of pads 21 are operated to sandwich, move, and release the metal sheet material 100 by the drive mechanism (not shown) of the material feeding unit 20.

The material feeding unit 20 moves the pair of pads 21 in a forward feed direction with the metal sheet material 100 sandwiched between the pair of pads 21. In this way, the metal sheet material 100 is fed into the die-set unit 30 in the subsequent stage while drawn out of the material magazine 11 (conveying direction D). After the metal sheet material 100 has been fed by a predetermined amount at a predetermined timing, as illustrated in FIG. 3A, the metal sheet material 100 sandwiched between the pair of pads 21 is released, and the pair of pads 21 are returned to their original position. At timings of the blanking with use of the die set 31, the material feeding unit 20 repeats such sandwiching and moving of the metal sheet material 100 in the forward feed direction with use of the pair of pads 21, releasing of the metal sheet material 100, and returning to the original position. In this way, the forward feeding of the metal sheet material 100 into the conveying direction D and the blanking with use of the die set 31 are successively performed, and the metal components 150 are sequentially blanked out of the metal sheet material 100.

(Guide Unit)

Figure 4A:
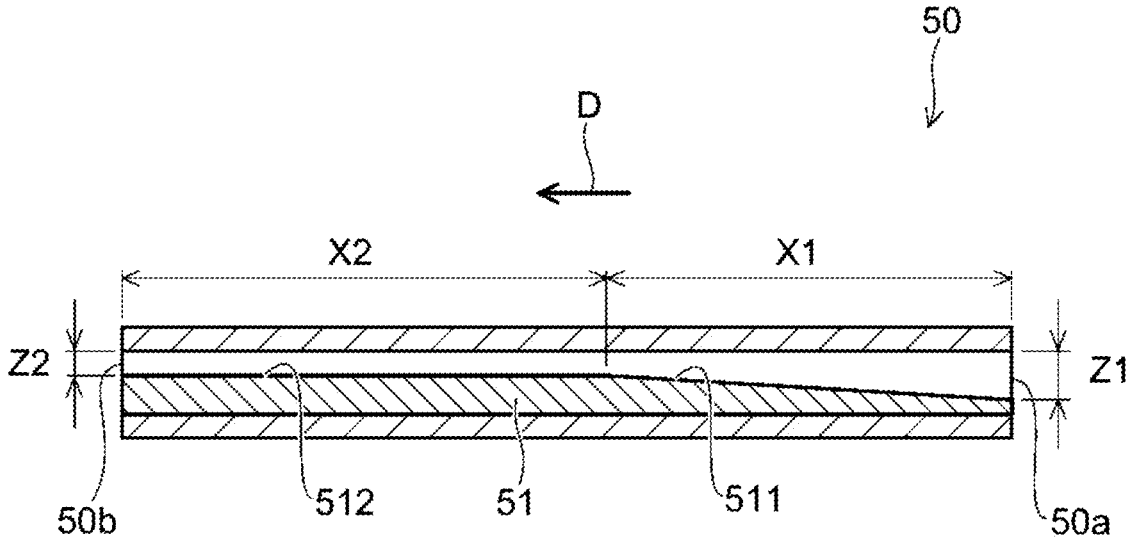
FIG. 4A and FIG. 4B are exemplary schematic views of a configuration of a guide unit.
Figure 4B:
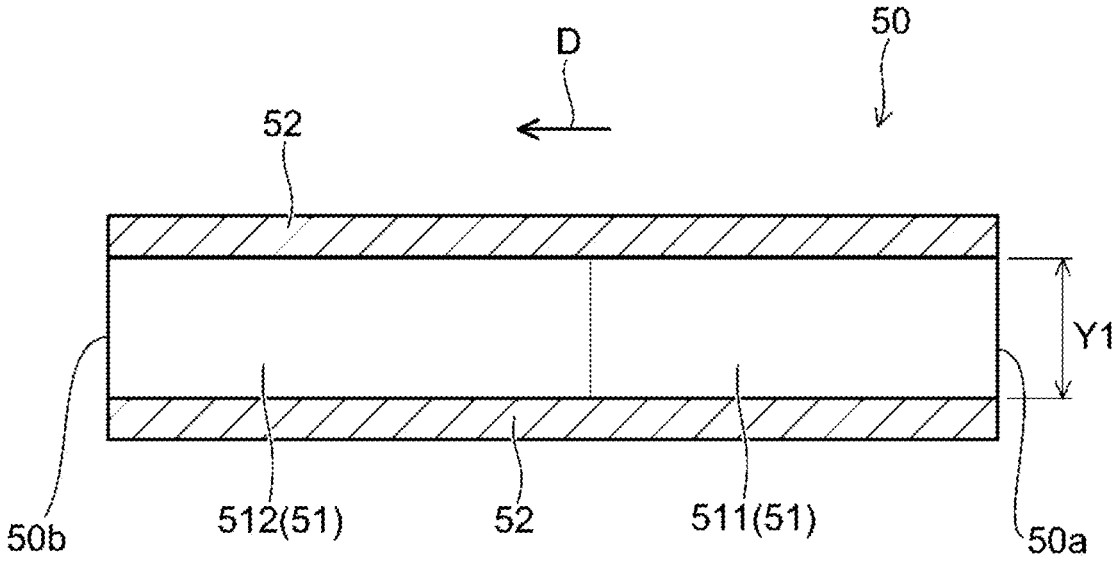

FIG. 4A and FIG. 4B are exemplary schematic views of a configuration of the guide unit.

Figure 5:
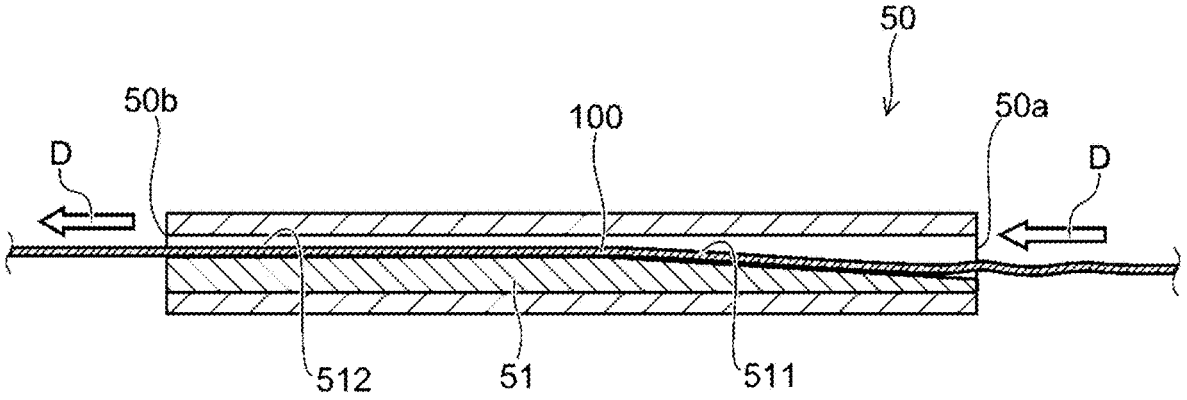
FIG. 5 is an exemplary schematic view illustrating a state in which a metal sheet material is guided by the guide unit.

FIG. 5 is an exemplary schematic view illustrating a state in which the metal sheet material is guided by the guide unit.

The guide unit 50 has a function to guide the metal sheet material 100 that is fed forward to the die-set unit 30 from the material feeding unit 20, thus stably feeding the metal sheet material 100 into the die-set unit 30. For example, the metal sheet material 100 is held in the roll shape by the material magazine 11, and hence remains curled (curved) according to the roll shape still at a time of being drawn out. In addition, as in the above-described material feeding unit 20, in a mechanism that feeds forward the metal sheet material 100 by repeating the sandwiching of the metal sheet material 100 with use of the pair of pads 21 and the releasing of the metal sheet material 100, the metal sheet material 100 is fed forward in a manner that the metal sheet material 100 is pulled while sandwiched between the pair of pads 21. Thus, the metal sheet material 100 is liable to be curved or warped by force applied from the pads 21. In particular, if the metal sheet material 100 is made of a soft precious metal such as gold, the metal sheet material 100 is liable to be further curved or warped. The guide unit 50 is configured to feed out such a metal sheet material 100 into the die-set unit 30 while correcting the curve or the warp to flatten the metal sheet material 100 to an extent that the forward feeding is not hindered.

In this embodiment, the guide unit 50 includes a thickness restricting portion 51 that restricts the metal sheet material 100 in its thickness direction. The thickness restricting portion 51 is provided on a side where an inlet 50*a* for the metal sheet material 100 is present among sides of the guide unit 50, and includes a slope portion 511 for reducing a clearance in the thickness direction from an upstream side to a downstream side in the conveying direction D of the metal sheet material 100. The guide unit 50 has a structure with a tubular interior space through which the metal sheet material 100 is passed, and the thickness restricting portion 51 that restricts the metal sheet material 100 in the thickness direction is provided in the tubular interior space.

The slope portion 511 is provided in an area over a distance X1 from the side where the inlet 50*a* is present among the sides of the guide unit 50 to the downstream side in the conveying direction D. The slope portion 511 has an inclination that gradually increases over the distance X1 from the inlet 50*a* of the guide unit 50. The clearance gradually decreases in a height direction of a space of a part at which the slope portion 511 is provided, specifically, decreases from a height Z1 on the side where the inlet 50*a* is present to a height Z2 on the downstream side in the conveying direction D.

The thickness restricting portion 51 includes a flat portion 512 that is provided on a side where an outlet 50*b* is present among the sides of the guide unit 50 relative to the slope portion 511. The flat portion 512 is a part that maintains the clearance in the thickness direction on the downstream side in the conveying direction D in the slope portion 511. In this embodiment, the flat portion 512 is provided in an area over a distance X2 subsequent to the distance X1 in the guide unit 50. At a time of feeding forward the metal sheet material 100 from the magazine holding unit 10 to the die-set unit 30, the metal sheet material 100 that has been fed in the guide unit 50 reaches the slope portion 511 first. In the slope portion 511, the clearance in the height direction gradually decreases in the conveying direction D. Thus, even when the metal sheet material 100 has been, for example, curved (specifically, corrugated) or warped on the side where the inlet 50*a* is present among the sides of the guide unit 50 as illustrated in FIG. 5, by passing the metal sheet material 100 through the slope portion 511, the metal sheet material 100 is restricted in the height direction. With this, the curve or the warp of the metal sheet material 100 is corrected.

At this time, the metal sheet material 100 can be easily fed into the guide unit 50. This is because the slope portion 511 of the guide unit 50 is provided on the side where the inlet 50*a* is present, and hence the clearance is somewhat large on the side where the inlet 50*a* is present. Further, by passing the metal sheet material 100 through the slope portion 511, the clearance gradually decreases in the height direction of the metal sheet material 100. In accordance therewith, the curve or the warp of the metal sheet material 100 is corrected.

Still further, as illustrated in FIG. 4B, the guide unit 50 further includes a width restricting portion 52 that restricts the metal sheet material 100 in its width direction. A position in the width direction of the metal sheet material 100 that has been fed in the guide unit 50 is restricted by the width restricting portion 52.

Such a guide unit 50 corrects the curve or the warp of the metal sheet material 100 in the roll shape. In addition, the width restricting portion 52 restricts the position in the width direction of the metal sheet material 100. With this, the metal sheet material 100 can be stably supplied from the guide unit 50 to the die-set unit 30.

Note that, the height Z2 being a clearance in the thickness direction on the downstream side in the conveying direction D in the slope portion 511 is preferred to be ⅓ or more and ½ or less of the height Z1 being a clearance in the thickness direction on the upstream side in the conveying direction D. With this, the somewhat large clearance is provided on the upstream side in the conveying direction D in the slope portion 511, which enables the metal sheet material 100 to be easily fed into the guide unit 50. Thus, the clearance is gradually restricted to ⅓ or more and ½ or less toward the downstream side in the conveying direction in the slope portion 511. In this way, the metal sheet material 100 can be gradually restricted in its thickness direction.

As a specific example, when the thickness of the metal sheet material 100 is 0.2 mm, the height Z1 on the side where the inlet 50*a* is present in the slope portion 511 is 1.8 mm, and the height Z2 on the side where the outlet 50*b* is present in the slope portion 511 is 0.7 mm. Thus, when the metal sheet material 100 with the thickness of 0.2 mm is fed into the guide unit 50, on the side where the outlet 50*b* is present, a clearance of 0.25 mm is formed between the guide unit 50 and each of an upper side and a lower side of the metal sheet material 100. The curve and the warp of the metal sheet material 100 in the height direction fall within this range. In addition, the inclination of the slope portion 511 is approximately 5 degrees to 7 degrees. By setting the inclination to this range, the metal sheet material 100 can be corrected while increase in conveying resistance to be generated at a time of correcting, with use of the slope portion 511, the curve and the warp of the metal sheet material 100 that has been fed in the guide unit 50 is sufficiently suppressed.

(Manufacturing Method for Cup Chain)

Next, a manufacturing method for the cup chain is described. FIG. 6A to FIG. 7B are exemplary views illustrating the manufacturing method for the cup chain.

Figure 6A:
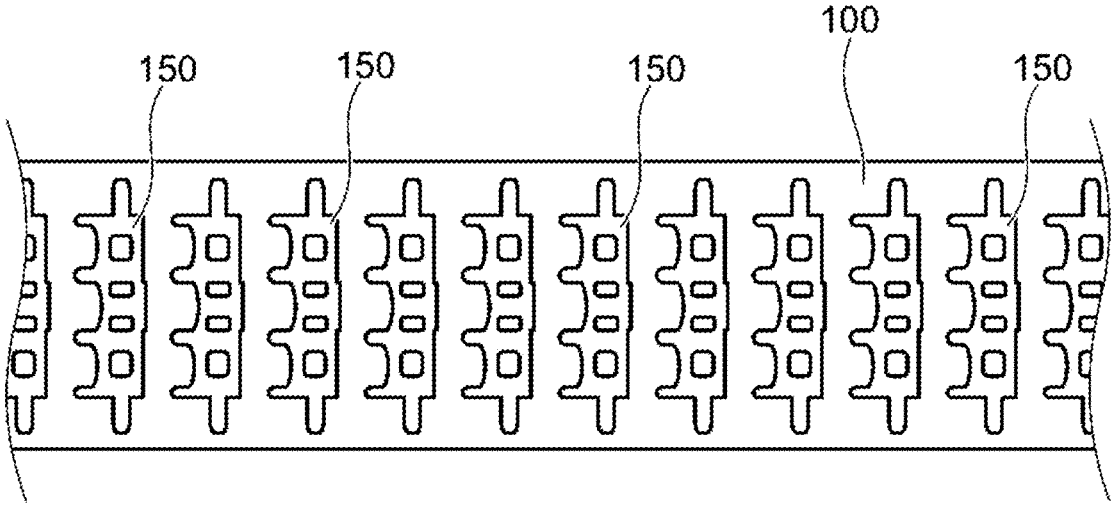
FIG. 6A and FIG. 6B are exemplary views illustrating a manufacturing method for a cup chain.
Figure 6B:
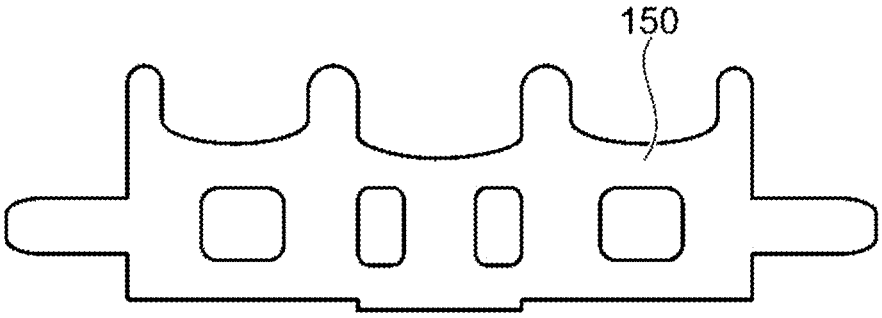

First, as illustrated in FIG. 6A, the long metal-sheet material 100 is blanked. Specifically, with use of the manufacturing apparatus 1 according to this embodiment, the metal sheet material 100 is fed forward from the material magazine 11 to the die set 31, and then blanked. The forward feeding is performed at predetermined timings by the material feeding unit 20. The metal sheet material 100 that has been fed forward to the die set 31 in the die-set unit 30 is successively blanked by the die set 31 while fed forward. The metal components 150 are formed by blanking the metal sheet material 100. As illustrated in FIG. 6B, the metal components 150 are each the flat-sheet-shaped component formed by blanking the metal sheet material 100 into a predetermined shape.

Figure 7A:
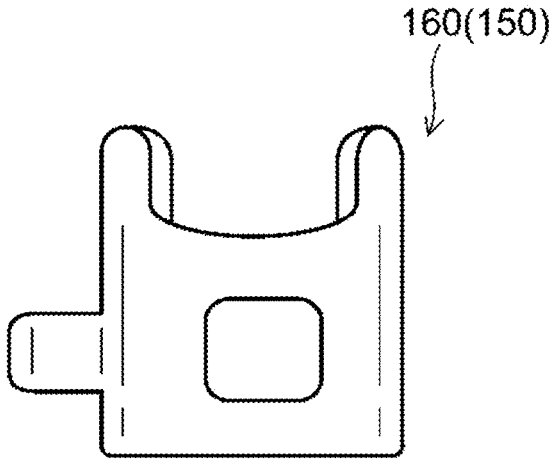
FIG. 7A and FIG. 7B are other exemplary views illustrating the manufacturing method for the cup chain.
Figure 7B:
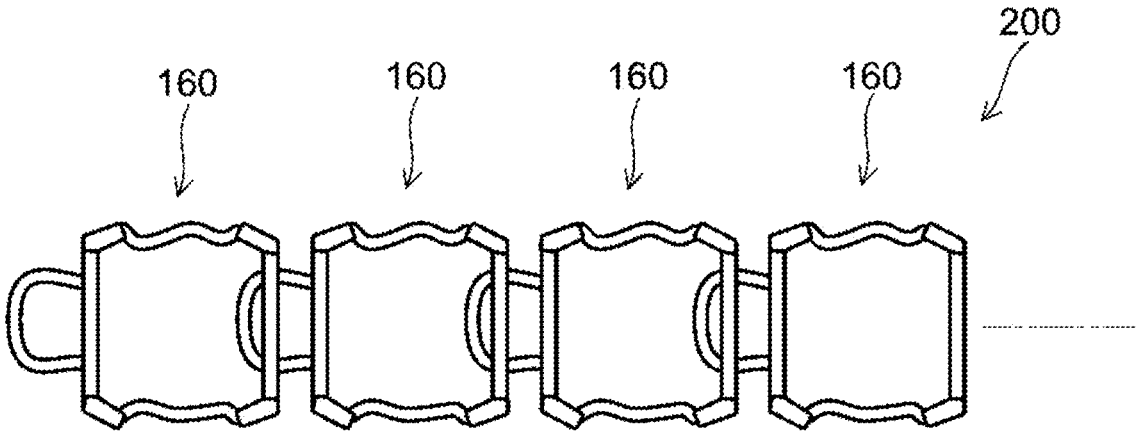

The metal components 150 blanked out of the metal sheet material 100 are fed from the die-set unit 30 to the machining unit 40. In the manufacturing apparatus 1 according to this embodiment, the metal components 150 are conveyed from the die-set unit 30 to the machining unit 40 automatically at the timings of feeding forward the metal sheet material 100. In the machining unit 40, the metal components 150 conveyed from the die-set unit 30 are bent one by one to form the three-dimensional box-shaped cup 160 illustrated in FIG. 7A. At a time of forming the cup 160, the metal component 150 is bent into the box shape while coupled to another cup 160 that has been previously formed. In this way, the cup chain 200 as illustrated in FIG. 7B is formed. The machining unit 40 couples subsequent cups 160 sequentially to cups 160 at an end portion of the cup chain 200. Thus, in the manufacturing apparatus 1, the cup chains 200 are successively formed by repeating the forward feeding and the blanking of the metal sheet material 100, and the forming of the cups 160 and the coupling to the cup chain 200, and then delivered to the product catching unit 60.

Figure 8:
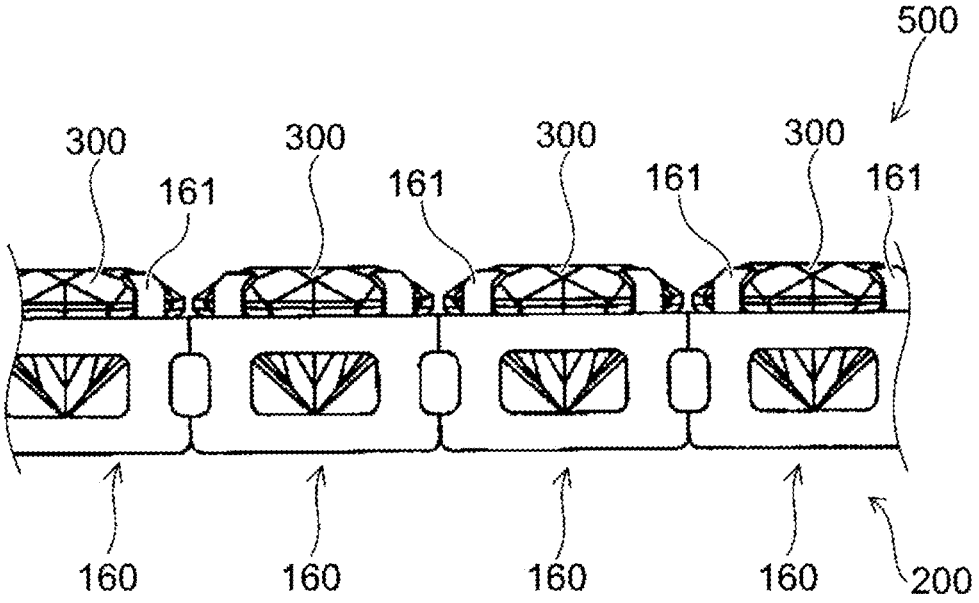
FIG. 8 is an exemplary view of an accessory using the cup chain.

FIG. 8 is an exemplary view of an accessory using the cup chain.

The cup chain 200 is manufactured with use of the manufacturing apparatus 1 according to this embodiment, and then decorative members 300 such as jewelry are incorporated respectively into the cups 160. With this, an accessory 500 is completed. Under the state in which the decorative members 300 are incorporated in the cups 160, the decorative members 300 are held by claws 161. Note that, examples of the decorative members 300 include jewelry such as gemstones, laboratory-created gemstones, precious stones, and simulated gemstones. In addition, examples of the accessory 500 using the cup chain 200 include a bracelet, a necklace, an earring, a brooch, and a wristwatch band.

As described above, according to this embodiment, the roll-shaped metal sheet material 100 can be stably fed into the die set 31. Thus, problems with the supply of the metal sheet material 100 can be prevented, and the cup chains 200 can be successively formed.

Note that, the present invention is not limited to examples of this embodiment or to its application examples described above.

For example, the thickness restricting portion 51 need not necessarily include the flat portion 512 on the side where the outlet 50*b* for the metal sheet material 100 is present in the guide unit as described above in the example of the embodiment of the present invention. According to another embodiment of the present invention, in the guide unit, the slope portion may be provided wholly from the side where the inlet for the metal sheet material is present to the side where the outlet for the same is present. Alternatively, in the guide unit, the flat portion may include flat portions that are provided on the side where the inlet for the metal sheet material is present and on the side where the outlet for the same is present with the slope portion sandwiched between these sides.

Further, the shape of the metal components 150 to be blanked out of the metal sheet material 100 and the shape of the cups 160 are merely examples, and other shapes may be employed.

Still further, components to be added as appropriate by persons skilled in the art to the above-described embodiments or to its application examples, components to be removed as appropriate by the persons from the above-described embodiments or from its application examples, design modification to be made as appropriate by the persons to the components, or combinations of features of the embodiments to be made as appropriate by the persons are also encompassed within the scope of the present invention as long as the gist of the present invention is not impaired.

The invention claimed is:

1. A manufacturing apparatus for an accessory, the manufacturing apparatus machining a metal sheet material in a roll shape into a cup chain, and comprising:

a magazine holding unit in which a material magazine that holds the metal sheet material in the roll shape is arranged;

a material feeding unit that is arranged in a stage subsequent to the magazine holding unit, and that repeats conveyance in which the metal sheet material is fed forward from the material magazine, and stop of the conveyance;

a die-set unit that is arranged in a stage subsequent to the material feeding unit, and that includes a die set which blanks the metal sheet material conveyed from the material feeding unit into a predetermined shape;

a machining unit that is arranged in a stage subsequent to the die-set unit; and a guide unit that is provided between the material feeding unit and the die-set unit, and that flattens and feeds the metal sheet material conveyed from the material feeding unit to the die-set unit, the guide unit including a thickness restricting portion that restricts the metal sheet material in a thickness direction of the metal sheet material, and the thickness restricting portion including a slope portion for reducing a clearance in the thickness direction from an upstream side to a downstream side in a conveying direction of the metal sheet material, the clearance being formed by the thickness restricting portion.

2. The manufacturing apparatus for the accessory according to claim 1, wherein the slope portion is provided on a side where an inlet for the metal sheet material is present among sides of the guide unit.

3. The manufacturing apparatus for the accessory according to claim 2, wherein the clearance in the thickness direction includes a clearance in the thickness direction on the downstream side in the conveying direction in the slope portion, and wherein the thickness restricting portion further includes a flat portion for maintaining the clearance in the thickness direction on the downstream side in the conveying direction in the slope portion, the flat portion being provided on a side where an outlet for the metal sheet material is present among the sides of the guide unit.

4. The manufacturing apparatus for the accessory according to claim 2, wherein the clearance in the thickness direction includes a clearance in the thickness direction on the upstream side in the conveying direction in the slope portion, and wherein the clearance in the thickness direction on the downstream side in the conveying direction in the slope portion is ⅓ or more and ½ or less of the clearance in the thickness direction on the upstream side in the conveying direction in the slope portion.

5. The manufacturing apparatus for the accessory according to claim 1, wherein the guide unit further includes a width restricting portion that restricts the metal sheet material in a width direction of the metal sheet material.

6. The manufacturing apparatus for the accessory according to claim 1, wherein the material feeding unit includes pads that sandwich a front and a rear of the metal sheet material, and repeats, in synchronization with timings of the blanking of the metal sheet material in the die-set unit, sandwiching the metal sheet material with use of the pads, feeding forward the metal sheet material that has been sandwiched between the pads, and releasing the metal sheet material from the pads.

* * * * *